US007703633B2

(12) United States Patent
Chen

(10) Patent No.: US 7,703,633 B2
(45) Date of Patent: Apr. 27, 2010

(54) MOUTHPIECE ASSEMBLY WITH A CAP

(75) Inventor: Han Min Chen, Taipei Hsien (TW)

(73) Assignee: Taiwan Vertex Production Corp., Taipei Hsien (TW)

( * ) Notice: Subject to any disclaimer, the term of this patent is extended or adjusted under 35 U.S.C. 154(b) by 1070 days.

(21) Appl. No.: 11/386,712

(22) Filed: Mar. 23, 2006

(65) Prior Publication Data

US 2007/0164037 A1 Jul. 19, 2007

(30) Foreign Application Priority Data

Dec. 29, 2005 (CN) ..... 2005 2 0200892 U

(51) Int. Cl.
*A47G 19/22* (2006.01)

(52) U.S. Cl. ..... 220/703; 220/714

(58) Field of Classification Search ..... 220/714, 220/707–709, 375, 379, 703; 222/175; 251/342; 215/306, 387, 388; 224/148.2
See application file for complete search history.

(56) References Cited

U.S. PATENT DOCUMENTS 5,004,114 A * 4/1991 Terbrusch et al. ..... 220/296
5,699,933 A * 12/1997 Ho et al. ..... 220/703
6,622,988 B2 * 9/2003 Gill ..... 251/351
6,994,269 B2 * 2/2006 Lien ..... 239/24
2007/0075094 A1 * 4/2007 Brown ..... 222/175
2007/0119809 A1 * 5/2007 Chen ..... 215/200

* cited by examiner

*Primary Examiner*—Robin Hylton
(74) *Attorney, Agent, or Firm*—Bacon & Thomas, PLLC

(57) ABSTRACT

A mouthpiece assembly includes a base connected with a hose and the base has a base tube in which a spring is received and a seal member is inserted in the base tube. The base tube has two symmetrical outlet notches defined in a top edge thereof and the seal member has two outlet holes which can be in alignment with the outlet notches when the seal member is moved to compress the spring. A mouthpiece is mounted on the base tube and has an outlet which is sealed by the seal piece on the seal member so that when the user squeezes the mouthpiece to move the seal member, the outlet is opened. A cap is removably mounted on the mouthpiece and can be positioned on two lugs on the base when being removed from the mouthpiece.

4 Claims, 6 Drawing Sheets

MOUTHPIECE ASSEMBLY WITH A CAP

FIELD OF THE INVENTION

The present invention relates to a mouthpiece assembly of a water bottle and the seal member is moved when the user squeezes the mouthpiece.

BACKGROUND OF THE INVENTION

There are two conventional mouthpiece assemblies and the first one is that the mouthpiece has a seal member with an inclined surface received therein and a spring is biased between the seal member and an inner end of the mouthpiece. A squeezing member radially connected to the mouthpiece and has an inclined surface which is matched with the inclined surface of the seal member. When the user wants to drink water, he or she has to push the squeezing member inward by his/her teeth such that the seal member is pushed a distance to allow the water to flow through the mouthpiece. However, the user has to precisely use his/her teeth to contact the squeezing member and this is not convenient for the user. Besides, a cap is mounted on the mouthpiece to prevent dust from entering the mouthpiece and a strip is connected between the mouthpiece and the cap. However, when the user removes the cap from the mouthpiece, the cap is not positioned and might hit the user's face. Furthermore, the shapes of the parts of the mouthpiece assembly are complicated and have to be manufactured by different machine and molds.

The second convention mouthpiece assembly includes a mouthpiece which includes a seal rod located therein and the seal rod is removably engaged with a base. When the user wants to drink water, he or she has to pull the mouthpiece away from the base such that the seal rod is disengaged from the base and the user can have the water. A cap is mounted on the mouthpiece so that the user has to hold the water bottle by one hand and remove the cap by the other hand, and then use the same hand to pull the mouthpiece. This is also not convenient for the users to use.

The present invention intends to provide a mouthpiece assembly with a simpler structure and the cap can be well positioned when being removed from the mouthpiece.

SUMMARY OF THE INVENTION

The present invention relates to a mouthpiece assembly for water bottles and the mouthpiece assembly comprises a base having a connection tube to be connected with a hose and a base tube which has two symmetrical outlet notches defined in a top edge thereof and two symmetrical connection slots are defined in a lower portion of the base tube. A seal member has a tubular body and a seal piece is located on a top of the tubular body with a neck connected between the seal piece and the tubular body. Two outlet holes are defined through a wall of the tubular body and two hooks are formed on an outer periphery of the tubular body. The tubular body is inserted into the base tube and the hooks are movably engaged with the connection slots. A spring is received in the base and has one end contacting a lower end of the tubular body to seal an outlet defined in a mouthpiece which is mounted on the base tube. The mouthpiece has a squeezing neck located beneath the outlet and an aperture is defined through the mouthpiece. A cap is mounted on the mouthpiece and has a connection stud connected on an outer periphery thereof. A strip has a first end connected to the strip ring and a second end of the strip is connected to the connection stud on the cap.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
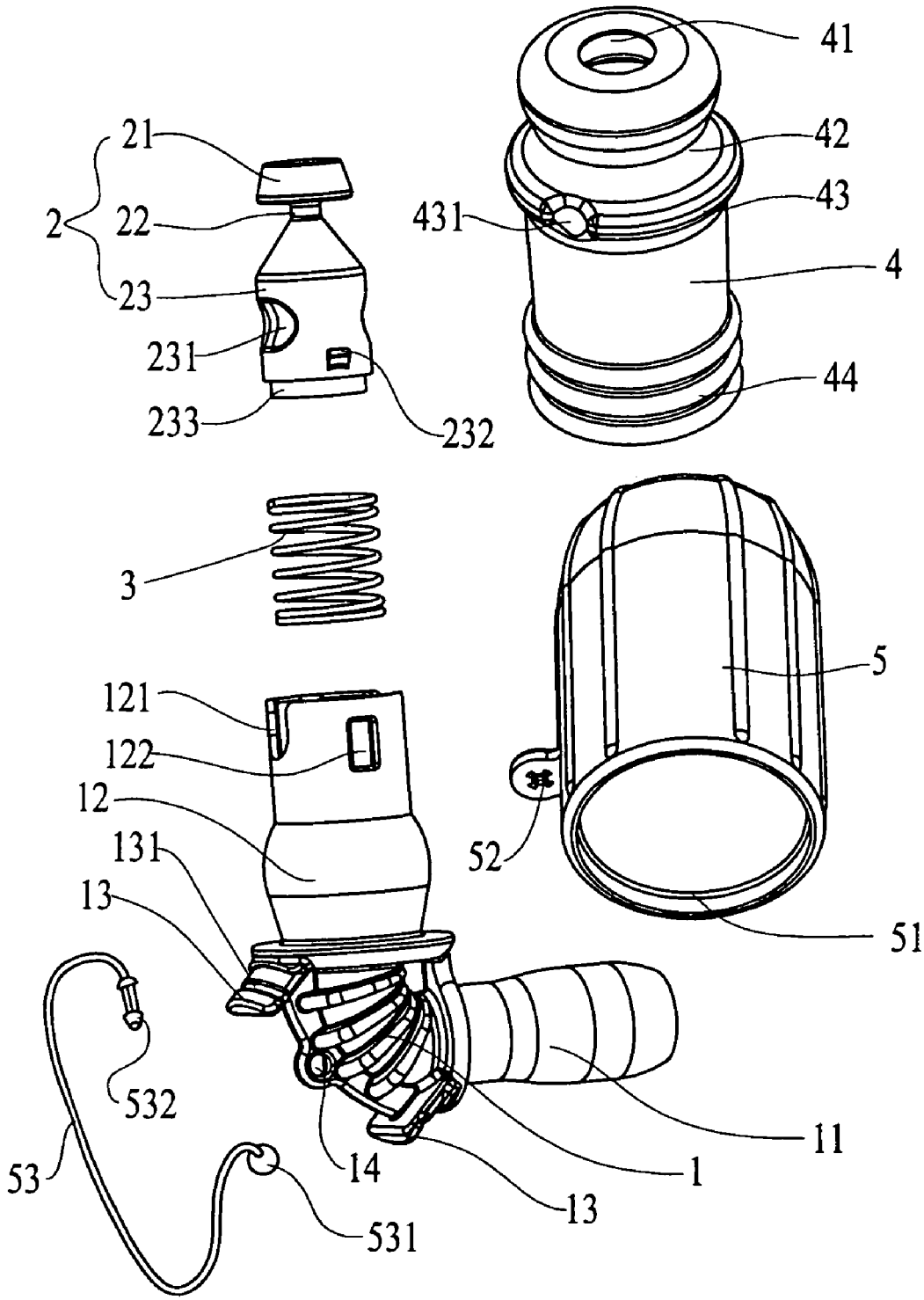
FIG. 1 is an exploded view to show the mouthpiece assembly of the present invention.
Figure 2:
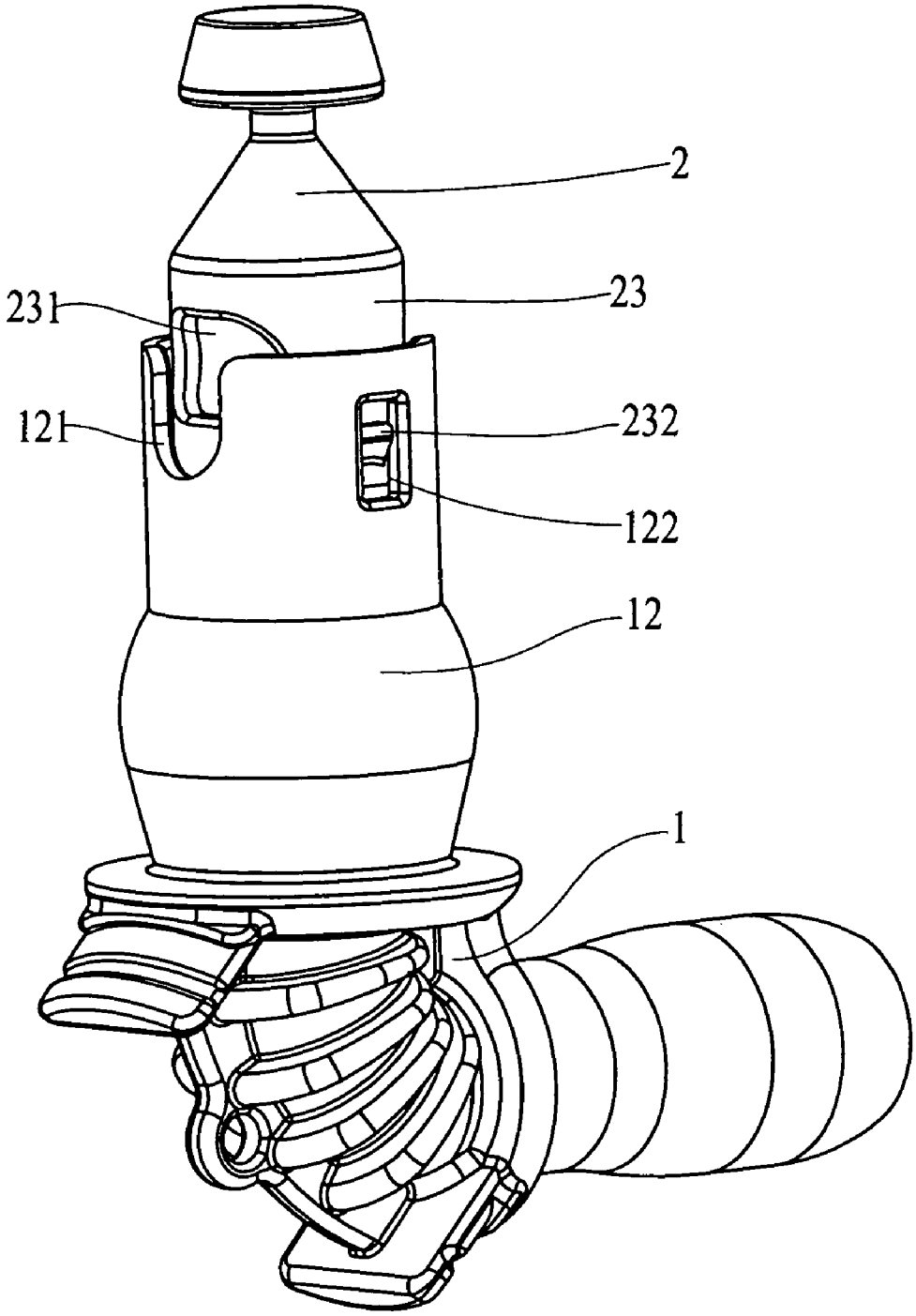
FIG. 2 is a perspective view to show that the seal member is inserted in the base tube of the mouthpiece assembly of the present invention.
Figure 3:
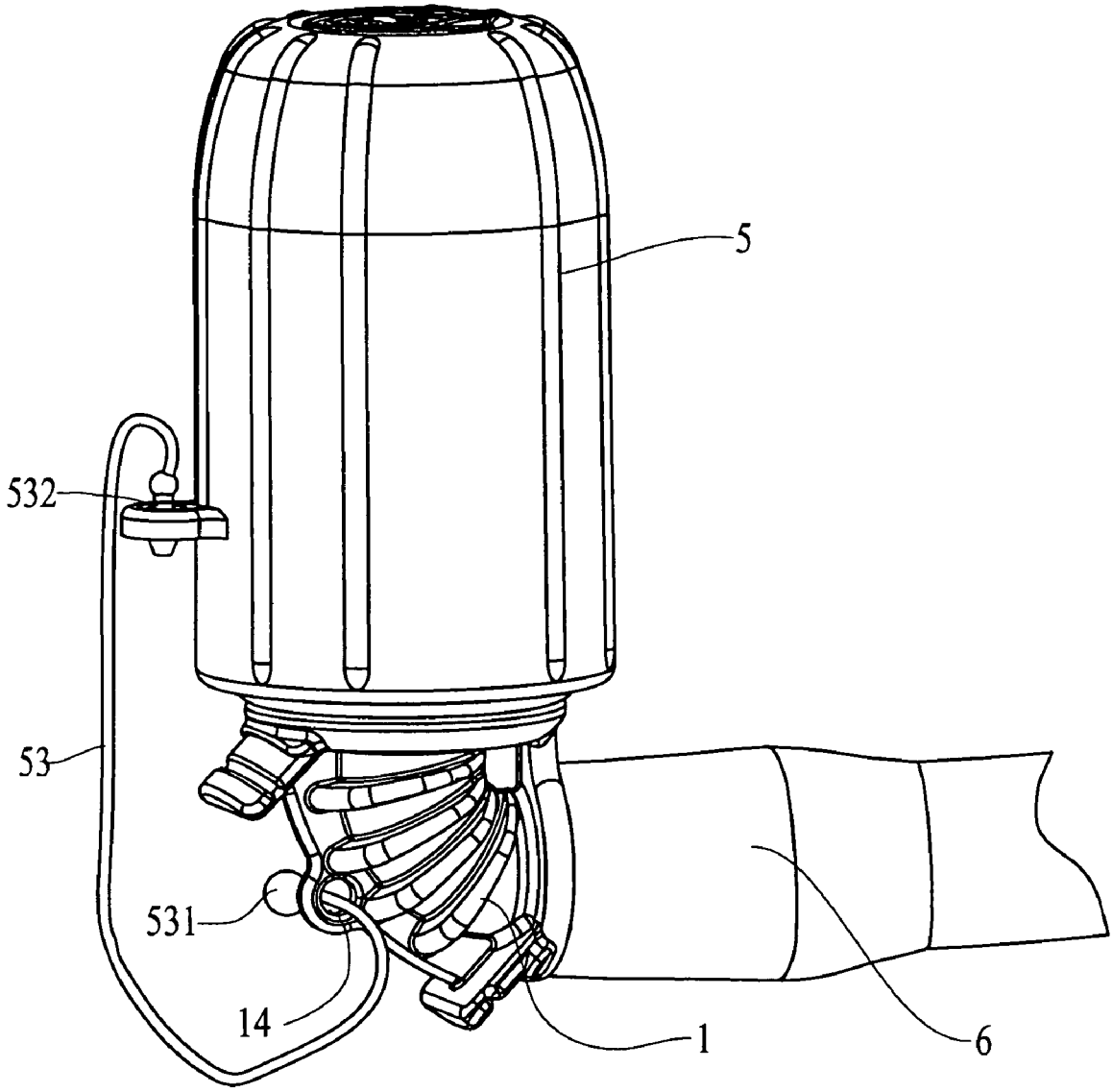
FIG. 3 is a perspective view to show the mouthpiece assembly of the present invention.
Figure 4:
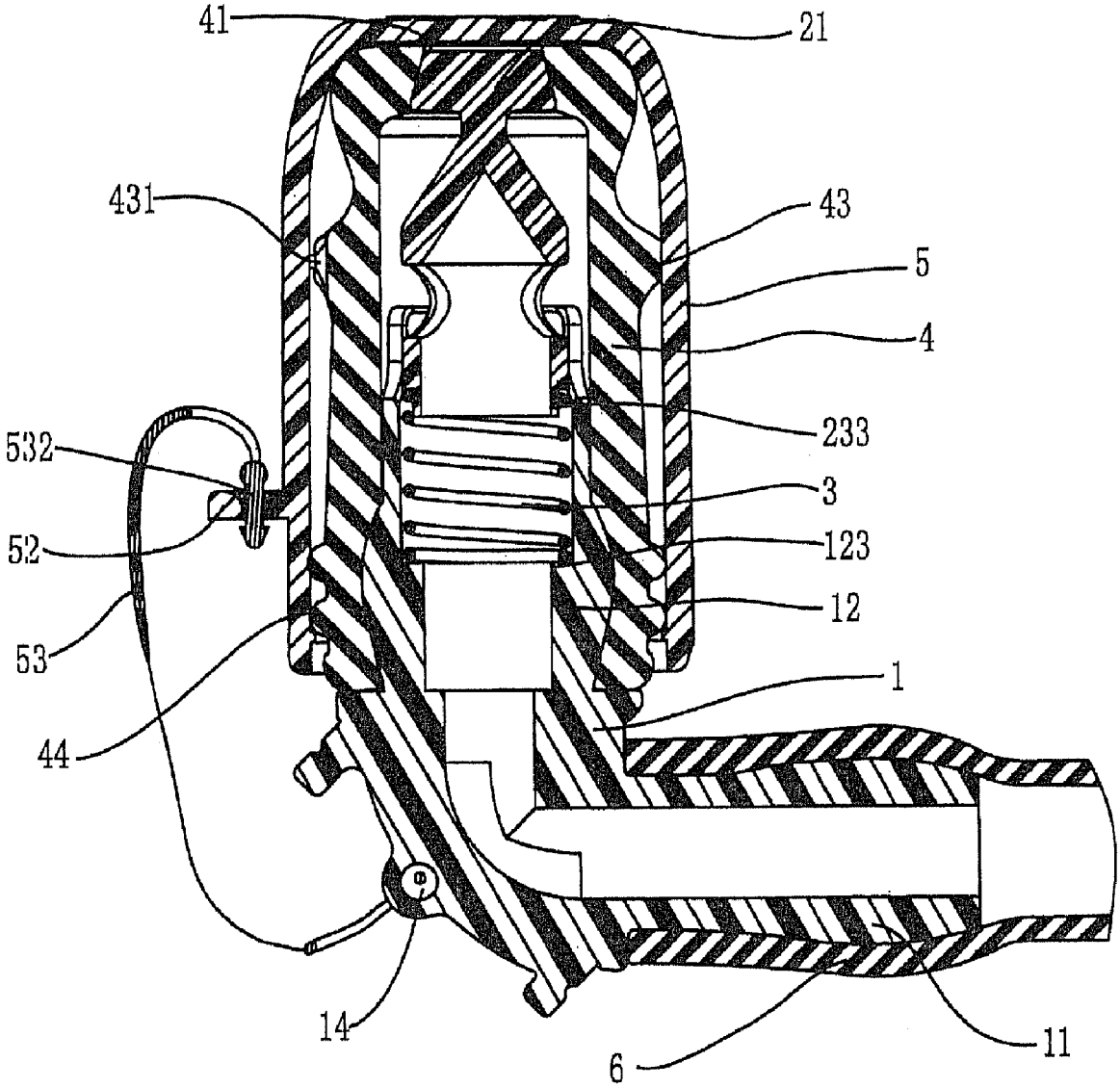
FIG. 4 is a cross sectional view of the mouthpiece assembly of the present invention.

Referring to FIGS. 1 to 4, the mouthpiece assembly for water bottles of the present invention comprises a base 1 having a connection tube 11 connected to an underside thereof so as to be connected to a hose 6 that is connected to the water bottle (not shown). A base tube 12 is connected to a top of the base 1 and has two symmetrical outlet notches 121 defined in a top edge thereof and two symmetrical connection slots 122 are defined in a lower portion of the base tube 12. The base tube 12 has a shoulder 123 extending from an inner periphery thereof. A strip ring 14 is located on an outer periphery of the base 1 and two lugs 13 are connected to the base 1 and each lug 13 has an engaging recess 131.

A seal member 2 has a tubular body 23 and a seal piece 21 is located on a top of the tubular body 23 with a neck 22 connected between the seal piece 21 and the tubular body 23. The tubular body 23 further has a spring mounting end 233 on the lower end thereof. Two outlet holes 231 defined through a wall of the tubular body 23 and two hooks 232 are formed on an outer periphery of the tubular body 23. The tubular body 23 is inserted into the base tube 12 and a spring 3 is received in the base 1. The spring 3 has one end mounted on the spring mounting end 233 and the other end of the spring 3 is rested on the shoulder 123. The outlet holes 231 are in alignment with the outlet notches 121 and the hooks 232 are movably engaged with the connection slots 122.

A mouthpiece 4 has an outlet 41 defined in a top thereof and a squeezing neck 42 is located beneath the outlet 41. A reinforcement rib 43 is connected to a lower portion of the squeezing neck 42 and an aperture 431 is defined through the reinforcement rib 43. The mouthpiece 4 is mounted on the base tube 12 and a plurality of reinforcement flanges 44 extend from an outer periphery of the mouthpiece 4 so as to increase the connection between the mouthpiece 4 and the base tube 12. The seal piece 21 of the seal member 2 is engaged with and seals the outlet 41 when the mouthpiece 4 is not squeezed.

A cap 5 is mounted on the mouthpiece 4 and has a connection stud 52 connected on an outer periphery thereof. A strip 53 has a connection sphere 531 on a first end thereof so as to be engaged with the strip ring 14 on the base 1, and an insertion member 532 is connected to a second end of the strip 53 so as to extend through the connection stud 52.

Figure 5:
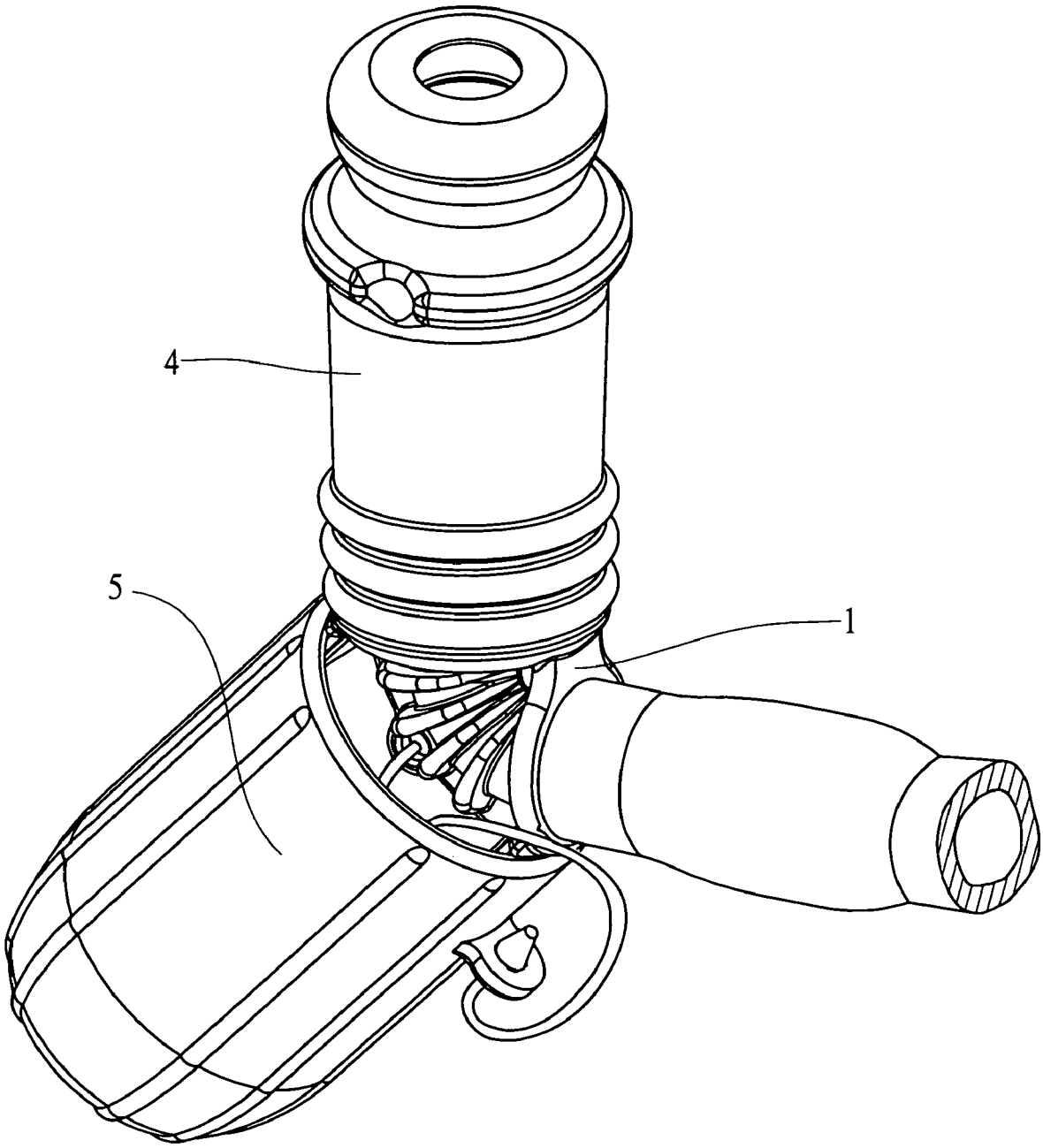
FIG. 5 shows that the cap of the mouthpiece assembly of the present invention is removed and positioned on the lugs.
Figure 6:
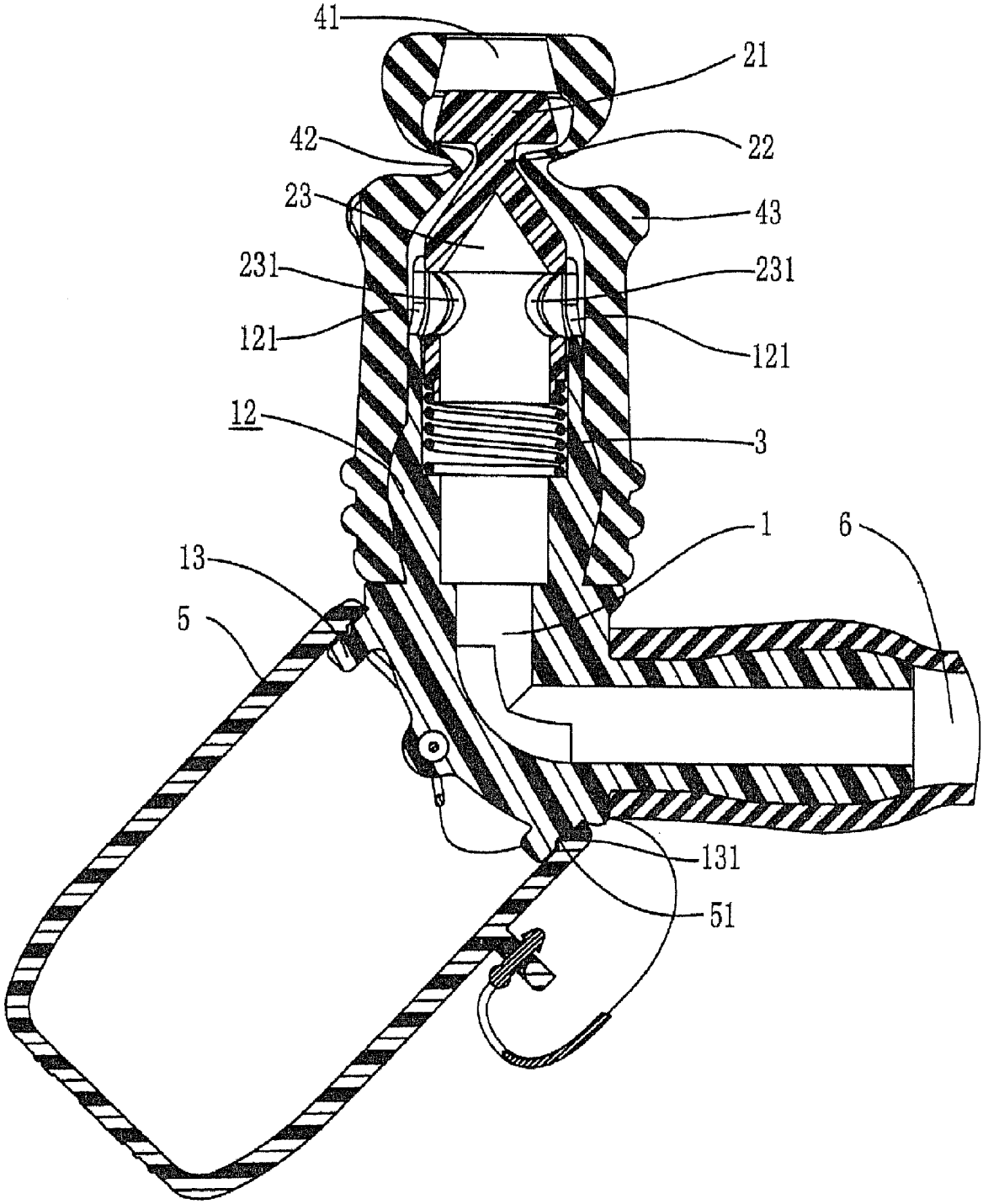
FIG. 6 is a cross sectional view of the mouthpiece assembly in FIG. 5.

Referring to FIGS. 5 and 6, when the user wants to drink water in the water bottle, he/she removes the cap 5 from the mouthpiece 4 and the cap 5 has an inner flange 51 extending radially from an inner periphery thereof. The cap 5 is mounted to the two lugs 13 with the inner flange 51 engaged with the engaging recesses 131 of the two lugs 13 to position the cap 5. The user squeezes the squeezing neck 42 by his/her teeth, the inward squeezing force by the teeth applies on the neck 22 of the seal member 2 to pull the seal piece 21 downward to disengage from the outlet 41. In the meanwhile, the inward squeezing force deforms the outlet 41 and helps the seal piece 21 to be disengaged from the outlet 41. The thickness on the reinforcement rib 43 is thicker than the squeezing neck 42 so that the reinforcement rib 43 does not deform severely and this ensures that the aperture 431 is not closed and the air in the mouthpiece 4 can escape from the aperture 431 when the user squeezes the mouthpiece 4. By this way, the user can drink the water via the outlet 41 of the mouthpiece 4 and the cap 5 is well positioned.

While we have shown and described the embodiment in accordance with the present invention, it should be clear to those skilled in the art that further embodiments may be made without departing from the scope of the present invention.

What is claimed is:

1. A mouthpiece assembly comprising:

a base having a bottom portion forming a connection tube and a top portion forming a base tube, the connection tube adapted to be connected with a hose and the base tube having two symmetrical outlet notches defined in a top edge thereof and two symmetrical connection slots defined in a lower portion of the base tube, the base having a strip ring formed on an outer periphery thereof;

a seal member having a tubular body and a seal piece is located on a top of the tubular body with a neck connected between the seal piece and the tubular body, two outlet holes defined through a wall of the tubular body and two hooks formed on an outer periphery of the tubular body, the tubular body inserted into the base tube, the outlet holes being in alignment with the outlet notches and the hooks movably engaged with the connection slots;

a spring received in the base and having one end contacting a lower end of the tubular body;

a mouthpiece having an outlet defined in a top thereof and a squeezing neck located beneath the outlet, a reinforcement rib connected to a lower portion of the squeezing neck and an aperture defined through the reinforcement rib, the mouthpiece mounted on the base tube and a plurality of protruding reinforcement flanges formed on an outer surface of the mouthpiece, the seal piece of the seal member engaged with the outlet, and a cap mounted on the mouthpiece and having a connection stud connected on an outer periphery thereof, a strip having a first end connected to the strip ring and a second end of the strip connected to the connection stud on the cap.

2. The assembly as claimed in claim 1, wherein two lugs are connected to the base and each lug has an engaging recess, the cap has an inner flange extending radially from an inner periphery thereof, the cap is mounted to the two lugs with the inner flange engaged with the engaging recesses of the two lugs.

3. The assembly as claimed in claim 1, wherein the strip has a connection sphere on the first end thereof and an insertion member is connected to the second end of the strip.

4. The assembly as claimed in claim 1, wherein the base tube has a shoulder extending from an inner periphery thereof and the tubular body has a spring mounting end on the lower end thereof, the spring has one end mounted on the spring mounting end and the other end of the spring is rested on the shoulder.

* * * * *